US005787803A

United States Patent [19]

Ohmura et al.

[11] Patent Number: 5,787,803

[45] Date of Patent: Aug. 4, 1998

[54] DOT LINE PRINTER WITH MIMIMUM HAMMER GAP ARRANGEMENT

[75] Inventors: Yuji Ohmura; Koichi Yageta, both of Hitachinaka, Japan

[73] Assignee: Hitachi Koki Co., Ltd., Tokyo, Japan

[21] Appl. No.: 966,697

[22] Filed: Nov. 10, 1997

[30] Foreign Application Priority Data

Nov. 8, 1996 [JP] Japan ..... 8-296032

[51] Int. Cl.[6] ..... B41J 9/00

[52] U.S. Cl. ..... 101/93.48; 400/124.28

[58] Field of Search ..... 101/93, 29–93.34, 101/93.37, 93.38, 93.4, 93.43, 93.48; 400/124.11, 124.12, 124.14, 124.15, 124.28, 124.29, 175

[56] References Cited

U.S. PATENT DOCUMENTS 3,311,050 3/1967 Schmidt ..... 101/93.32

3,606,834 9/1971 Nyman et al. ..... 101/93.34

4,070,963 1/1978 Weaver ..... 101/93.48

4,527,469 7/1985 Wolf et al. ..... 101/93.48

*Primary Examiner*—Ren Yan

*Attorney, Agent, or Firm*—Whitham, Curtis & Whitham

[57] ABSTRACT

In a dot line printer including a cylindrical platen for supporting a print paper and a hammer bank supporting a plurality of print hammers, the hammer bank is a double bank structure in which a first half of the print hammers are attached to the upper bank and the second half of the print hammers are attached to the lower bank. The positions of print pins in adjacent print hammers are shifted an amount corresponding to one dot so that a predetermined dot lines are printable with one scan of the hammer bank. In order to minimize the hammer gaps of the print hammers, the inner surfaces of the hammer banks are oriented in a direction in which those surfaces access to each other.

6 Claims, 5 Drawing Sheets

DOT LINE PRINTER WITH MIMIMUM HAMMER GAP ARRANGEMENT

BACKGROUND OF THE INVENTION

1. Field of the Invention

The present invention relates generally to a dot line printer, and more particularly to an arrangement of an upper hammer bank and a lower hammer bank.

2. Description of the Prior Art

A structure of a dot line printer will first be described. FIGS. 1(*a*) and 1(*b*) show a hammer module to be mounted on a hammer bank. A plurality of print hammers 3 (6 in the illustrated example) are formed in the upper portion of a leaf spring 1. A print pin 2 is attached to the top portion of each print hammer 3. The position on which the print pin 2 is attached is shifted an amount corresponding to one dot in the sheet feeding direction (vertical direction) with respect to the print pin position of the adjacent print hammer. The print hammers 3 are juxtaposed substantially at an equi-pitch along the print line (horizontal direction) perpendicular to the sheet feeding direction.

A print mechanism is shown in FIG. 2. The lower portion of the hammer module is fixedly secured to a base 6 with screws (not shown). The free end of the print hammer where the print pin 2 is attached is magnetically attracted to a pole 9 by a magnet 4. An electromagnetic coil 5 is provided to each print hammer 3. The coil 5 cancels the magnetic field created by the magnet 4 when a current flows in the coil 5 for a predetermined period of time. As a result, the print hammer 3 which has been magnetically attracted to the pole 9 is fired due to its restoring force and a dot of impression is made by the print pin 2 on a sheet of paper through an inking ribbon (not shown). The sheet of paper is held on a platen and is fed in the sheet a feeding direction.

A hammer bank 10 is configured by a plurality of hammer modules and a plurality of print mechanisms shown in FIG. 2. FIG. 3 illustrates a double bank structure in which two hammer banks are combined using joint blocks 7. The joint blocks 7 are attached to both ends of upper and lower banks. The hammer modules in the upper hammer bank are arranged so that the print pins 2 are oriented downwardly whereas the hammer modules in the lower hammer bank are arranged so that the print pins 2 are oriented upwardly. An equal number of hammer modules are arranged horizontally in each of the upper and lower hammer banks and the hammer modules in the upper and lower hammer banks are vertically aligned. With two hammer modules aligned vertically, twelve dot lines are simultaneously printable during one scan of the hammer bank. For printing one line of characters or symbols constructed with twenty-four dot lines, first twelve dot lines are printed when the hammer bank moves, for example, from the leftmost to the rightmost end. During a period of time when the hammer bank reverses at the rightmost end, the print paper is fed an amount corresponding to twelve dot lines so that the subsequent twelve dot lines can be printed during the subsequent scan of the hammer bank moving from the rightmost to the leftmost end. During the leftward movement of the hammer bank, another twelve dot lines are printed. One line printing is thus completed with two scans of the hammer bank. During a period of time when the hammer bank reverses at the leftmost end, the print paper is fed an amount corresponding to eighteen dot lines, twelve dot lines of which are for printing the upper half of the subsequent line and six dot lines of which are for reserving an interline space between two lines. In this manner, printing is carried out by the hammer bank which reciprocally moves along the print line.

As shown in FIG. 3, the conventional hammer bank is arranged so that the print pins 2 are at the same height from the inner surfaces of the joint blocks 7 which surfaces confront the peripheral surface of a platen 8. In another conventional hammer bank shown in FIG. 5, the heights of the print pins 2 are adjusted so that a line connecting the tip ends of the print pins 2 has a radium of curvature substantially equal to that of the cross-sectional circle of the platen 8.

However, with the arrangement of the print pins shown in FIG. 3, there is a big difference in a distance from the tip end of the print pin 2 to the peripheral surface of the platen 8 (which distance will hereinafter be referred to as "hammer gap"). In FIG. 4, the maximum hammer gap is indicated as gap 4, and the minimum hammer gap as gap 3. The difference (L1) between the maximum hammer gap 4 and the minimum hammer gap 3 causes the striking force of the corresponding print pins to differ. The difference in the striking force in turn causes the print density of the dot to change, and thus degrades the print quality.

Although the print pin arrangement shown in FIG. 5 can generate more uniform striking force than that shown in FIG. 3, it is extremely difficult to precisely position the print pins along a predetermined radius of curvature.

SUMMARY OF THE INVENTION

Accordingly, it is an object of the present invention to provide a dot line printer that can improve the print quality with an arrangement wherein the difference in the striking force of the print pins is made as minimum as possible. This can be accomplished by making the difference in the hammer gap minimum.

To achieve the above and other objects, there is provided according to the present invention a dot line printer that includes a cylindrical platen, a plurality of print hammers, and a hammer bank. The cylindrical platen has an axis and a peripheral surface for supporting a print paper thereon. The cross-section of the cylindrical platen is a circle. The print hammers are juxtaposed at a predetermined interval along a print line. That hammer bank is reciprocally movable along the print line. The hammer bank is a double bank structure having an upper bank and a lower bank wherein a first half of the plurality of print hammers are secured to the upper bank and a second half of the plurality of print hammers are secured to the lower bank. The print hammers have print pins at preselected locations along a paper feeding direction perpendicular to the print line so that n dot lines are printable simultaneously with the print hammers. The upper bank has a first surface confronting the peripheral surface of the cylindrical platen and the lower bank has a second surface confronting the peripheral surface of the cylindrical platen. The first surface and the second surface are combined at a boundary line and oriented in a direction to form a predetermined angle θ between each of the first surface and the second surface and a reference line perpendicular to the axis of the cylindrical platen and to a radial line of the cylindrical platen originating from a center of the circle and extending to pass through the boundary line.

It is most preferable that the predetermined angle is given by $$\theta = \cos^{-1}\sqrt{1-\frac{h^2}{4R^2}} + \sin^{-1}\frac{h(n/2-1)}{2R}$$

where R is a radius of the circle, and h is a difference in height between two adjacent hammer pins. The angle θ is more than zero. The number n is equal to or greater than two.

The hammer bank includes a joint block having a surface confronting the peripheral surface of the cylindrical platen. The surface of the joint block is substantially in flush with the first surface and the second surface.

BRIEF DESCRIPTION OF THE DRAWINGS

The particular features and advantages of the invention as well as other objects will become apparent from the following description taken in connection with the accompanying drawings, in which:

FIG. 1(*b*) is a side view showing the hammer module shown in FIG. 1(*a*);

DETAILED DESCRIPTION OF THE PREFERRED EMBODIMENT

A preferred embodiment of the present invention will be described while referring to the accompanying drawings. In the following description, the expressions "upper", "lower", "horizontal" and "vertical" are used throughout the description to define the various parts when the dot line printer is disposed in an orientation in which it is intended to be used.

Figure 1A:
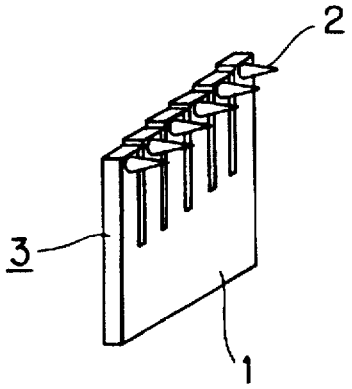
FIG. 1(a) PRIOR ART
FIG. 1(*a*) is a perspective view showing a hammer module.
Figure 1B:
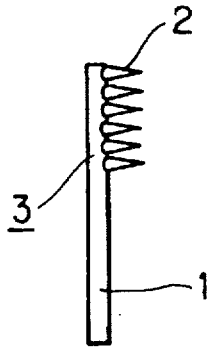
FIG. 1(b) PRIOR ART
Figure 2:
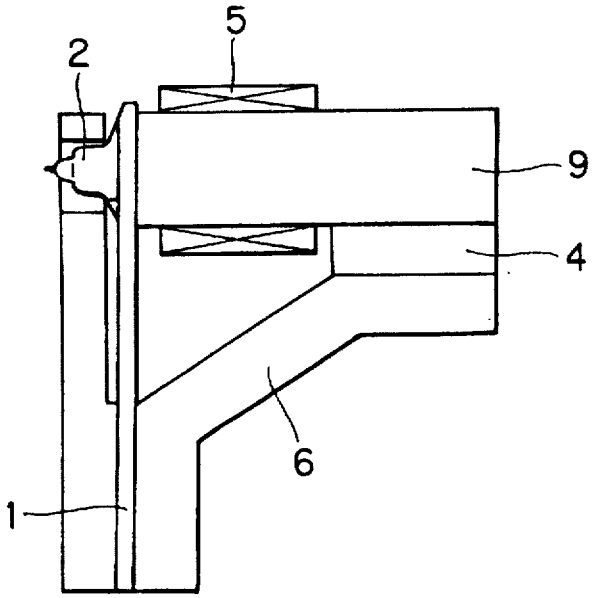
FIG. 2 PRIOR ART
FIG. 2 is a cross-sectional view showing an arrangement of a conventional print mechanism.
Figure 3:
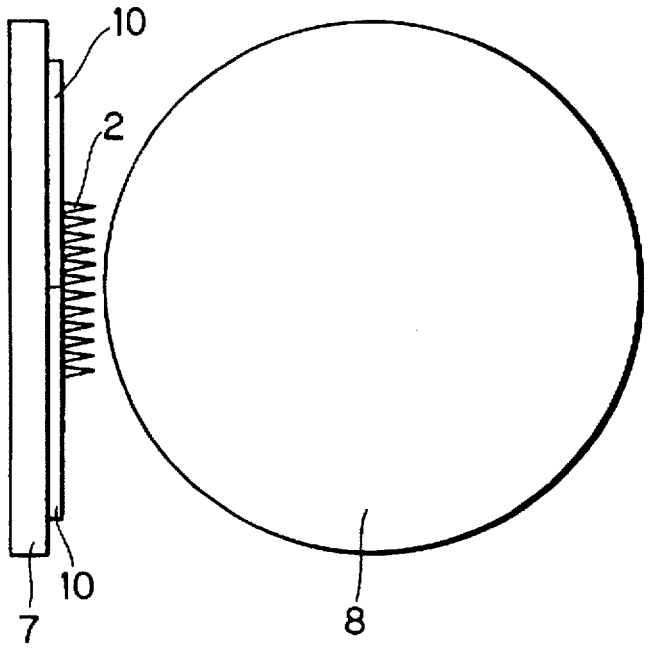
FIG. 3 PRIOR ART
FIG. 3 is a side view showing a conventional hammer bank.
Figure 6:
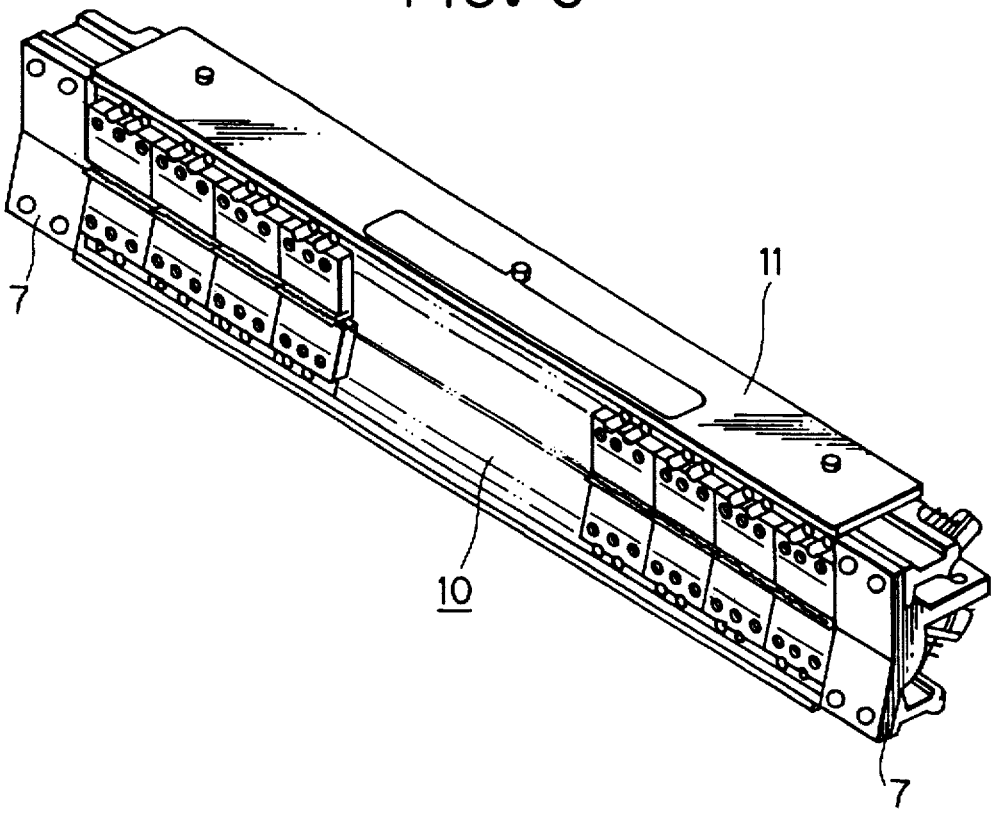
FIG. 6 is a perspective view showing a hammer bank according to a preferred embodiment of the present invention.
Figure 7:
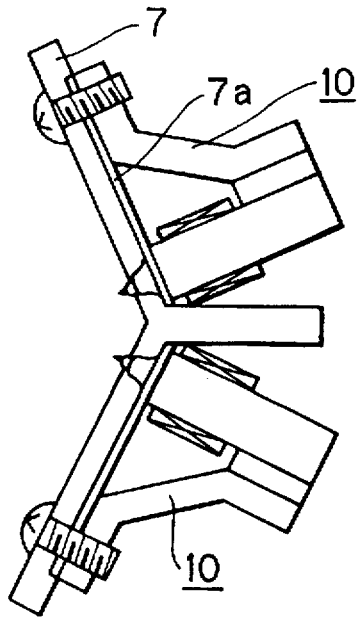
FIG. 7 is a cross-sectional view showing the hammer bank shown in FIG. 6.

FIG. 6 shows a hammer bank according to an embodiment of the present invention. FIG. 7 shows a cross-section of the hammer bank shown in FIG. 6. The hammer bank is a double bank structure having an upper bank and a lower bank. In each of the upper and lower banks, the same number of print units, each formed with a hammer module shown in FIGS. 1(*a*) and 1(*b*) and the print mechanism shown in FIG. 2, are tightly arranged in a side-by-side fashion. The hammer bank is assembled by fixedly securing the upper bank print units to an upper supporting plate 11 and the lower bank print units to a lower supporting plate (not shown). A joint block 7 is attached to each side end of the hammer bank thus assembled to support the same. The joint block 7 has a surface in confrontation with the peripheral surface of a platen 8. That surface of the joint block 7 is substantially in flush with the surface of the hammer module. The hammer module surfaces in the upper and lower banks are oriented in a direction in which these surfaces access to each other. The orientation of the hammer module surfaces is for making the hammer gaps in both the upper and lower banks as even as possible.

Figure 8:
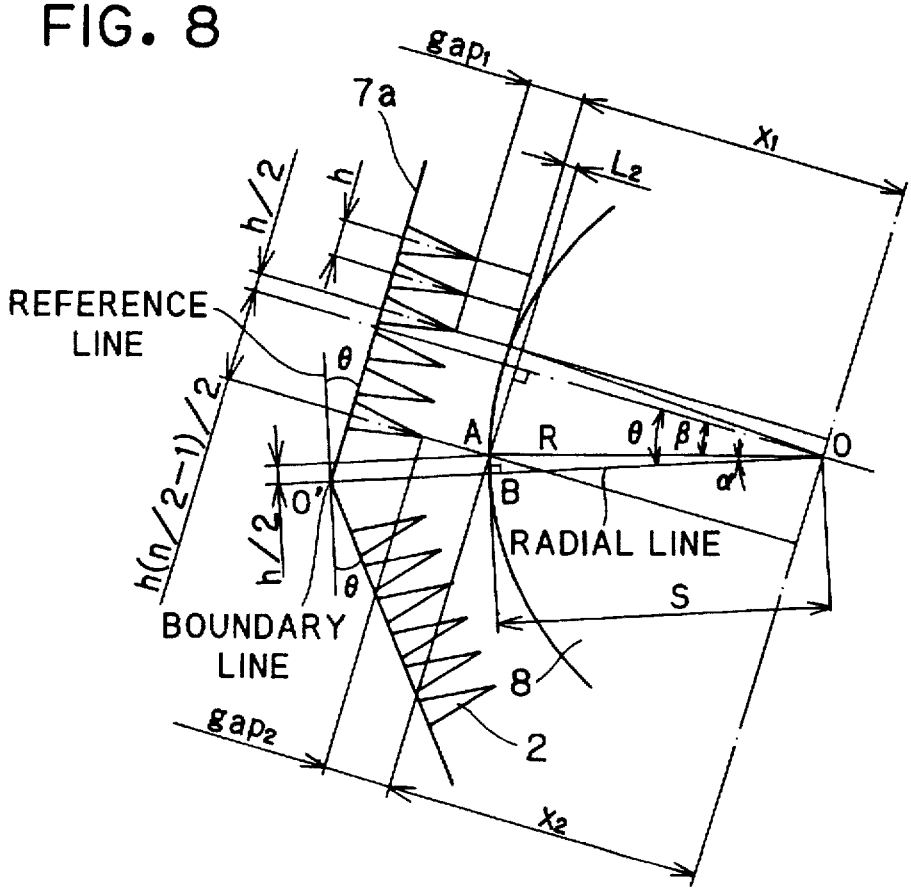
FIG. 8 is an enlarged side view showing the hammer gap in the hammer bank shown in FIG. 6.

Referring now to FIG. 8, a boundary line between the inner surfaces of the upper and lower hammer banks passes through point O' and extends in a direction perpendicular to the sheet of drawing. The boundary line is in parallel with a longitudinal axis of the platen 8 which passes through point O and extends in a direction perpendicular to the sheet of drawing. A radial line extending radially outwardly from the center O of the cross-sectional circle of the platen 8 and intersecting the boundary line will be referred to as "radial line" in the following description. Also, a line perpendicular to both the boundary line and the radial line will be referred to as "reference line". In the present embodiment, an angle θ formed between the reference line and the inner surface of the upper or lower hammer bank will be set to satisfy the following relation:

$$\theta = \cos^{-1}\sqrt{1-\frac{h^2}{4R^2}} + \sin^{-1}\frac{h(n/2-1)}{2R}$$

where R is a radius of the cross-sectional circle of the platen 8, h is a difference in height between two adjacent hammer pins, n is a number of dot lines to be simultaneously printable with one scan of the hammer bank. In the example shown in FIG. 8, n is equal to twelve (12), and in the example shown in FIG. 9, n is equal to twenty-four (24). As can be appreciated from the above equation, the angle θ is determined depending on the factors R, h and n.

The angle θ is so determined for the following reasons.

In FIG. 8, the point at which the axial line of the n/2th print pin counted from the top (sixth print pin in the illustrated embodiment) intersects the outer periphery of the platen 8 is denoted by "A", and an acute angle formed between the inner surface of the hammer module (or the inner surface 7*a* of the joint block 7) and a line normal to the radial line O–O' is denoted by θ. The point "B" is a crossing point of the radial line O–O' and a line passing through the point "A" and normal to the radial line O–O'. The line length OB is denoted by "S". Further, an angle ∠AOB is denoted by α, and an angle θ–α by β.

The angle formed by the inner surface 7*a* of the joint block 7 and the line normal to the radial line O–O', i.e., reference line, is θ and θ=α+β. Therefore, the following relationships are established.

$$S = R \cdot \cos\alpha$$

$$S^2 + \left(\frac{h}{2}\right)^2 = R^2$$

From the above two equations, the following relations are obtained.

$$R^2 \cdot \cos^2\alpha + \frac{h^2}{4} = R^2$$

$$\alpha = \cos^{-1}\sqrt{1-\frac{h^2}{4R^2}}$$

$$\sin\beta = \frac{\left\{\frac{h(n/2-1)}{2}\right\}}{R}$$

$$\beta = \sin^{-1}\frac{h(n/2-1)}{2R}$$

Accordingly, the angle θ can be computed by the following equation where the angle θ is more than zero.

$$\theta = \cos^{-1}\sqrt{1-\frac{h^2}{4R^2}} + \sin^{-1}\frac{h(n/2-1)}{2R}$$

Figure 4:
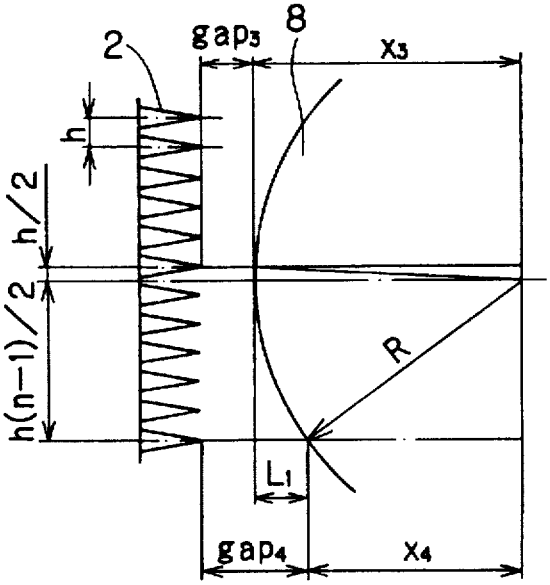
FIG. 4 PRIOR ART
FIG. 4 is an enlarged side view showing the hammer gap portion in the hammer bank shown in FIG. 3.
Figure 5:
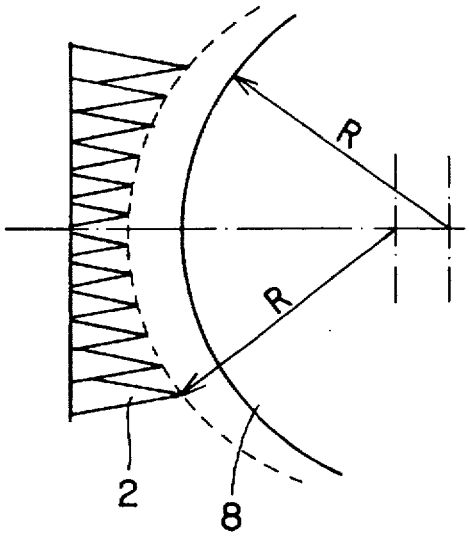
FIG. 5 PRIOR ART
FIG. 5 is an enlarged side view showing the hammer gap portion in another conventional hammer bank.

In the prior art shown in FIG. 4, the difference $L_1$ in the hammer gaps is given by:

$$L_1 = gap4 - gap3 = x3 - x4.$$

In contrast, in the preferred embodiment of the invention shown in FIG. 8, the difference $L_2$ in the hammer gaps is given by:

$$L_2 = gap2 - gap1 = x1 - x2$$

where gap3 and gap1 are assumed to be equal to each other. According to the Pythagorean theorem, $$L_1 - L_2 = x2 - X4(x3 = x1) =$$

$$\sqrt{R^2 - \left\{\frac{h\left(\frac{n}{2}-1\right)}{2}\right\}^2} - \sqrt{R^2 - \left\{\frac{h(n-1)}{2}\right\}^2}$$

where $$(X2 - X4)(X2 + X4) = X2^2 - X4^2 =$$

$$\left[R^2 - \left\{\frac{h\left(\frac{n}{2}-1\right)}{2}\right\}^2\right] - \left[R^2 - \left\{\frac{h(n-1)}{2}\right\}^2\right] = \frac{h^2}{4}n\left(\frac{3}{4}n-1\right) > 0$$

Because $n \geqq 2$, $x2-x4>0$.

Therefore, $L_1-L_2>0$, that is, $L_1>L_2$.

It would be clear from the above description that a difference between the maximum hammer gap and the minimum hammer gap is smaller than that in the conventional structure.

While only one exemplary embodiment of this invention has been described in detail, those skilled in the art will recognize that there are many possible modifications and variations which may be made in this exemplary embodiment while yet retaining many of the novel features and advantages of the invention. For example, although in the hammer bank arrangement shown in FIG. 8, the uppermost and lowermost print pins of each of the upper and lower hammer bank, that is, the 1st, 6th, 7th and 12th print pins counted from the top, are positioned to have the same hammer gap, it is not absolutely necessary to do so.

Figure 9:
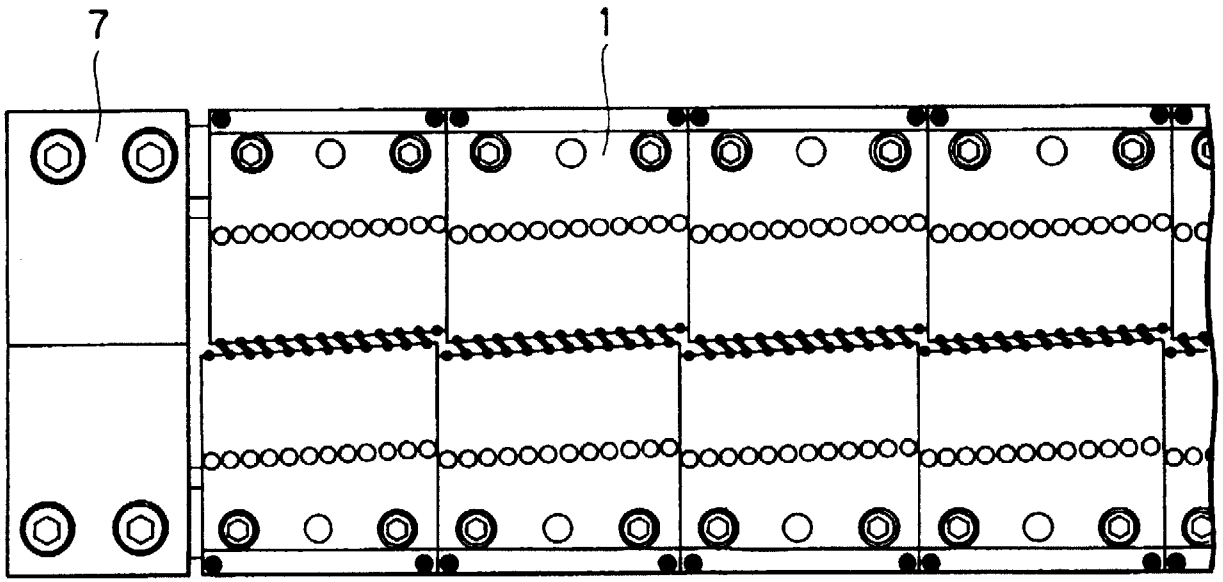
FIG. 9 is a front view showing a hammer bank according to another embodiment of the present invention.

The structure shown in FIG. 9 is capable of simultaneously printing twenty-four dot lines with one scan of the hammer bank. It is desirable that among the $_1$st to 12th print pins in the upper hammer bank and 13th to 24th print pins in the lower hammer bank, the 1st, 12th, 13th and 24th print pins are secured to have the same hammer gap.

In the present invention, the number of print hammers mounted on the hammer bank is not limited to those described above.

According to the present invention, the difference in the hammer gap can be easily minimized without increasing the manufacturing cost. The minimum hammer gap difference can minimize the variation in the striking force by the respective hammers and thus the print quality can be improved.

What is claimed is:

1. A dot line printer comprising:

a cylindrical platen having an axis and a peripheral surface for supporting a print paper thereon, a cross-section of said cylindrical platen being a circle;

a plurality of print hammers juxtaposed at a predetermined interval along a print line; and a hammer bank reciprocally movable along the print line, said hammer bank comprising a double bank structure having an upper bank and a lower bank wherein a first half of said plurality of print hammers are secured to said upper bank and a second half of said plurality of print hammers are secured to said lower bank, said plurality of print hammers having print pins at preselected locations along a paper feeding direction perpendicular to the print line so that n dot lines are printable simultaneously with said plurality of print hammers, wherein said upper bank has a first surface confronting the peripheral surface of said cylindrical platen and said lower bank has a second surface confronting the peripheral surface of said cylindrical platen, the first surface and the second surface being combined at a boundary line and being oriented in a direction to form a predetermined angle θ between each of the first surface and the second surface and a reference line perpendicular to the axis of said cylindrical platen and to a radial line of said cylindrical platen originating from a center of the circle and extending to pass through the boundary line, wherein said angle θ is greater than zero.

2. The dot line printer according to claim 1, wherein the predetermined angle θ is defined by $$\theta = \cos^{-1}\sqrt{1-\frac{h^2}{4R^2}} + \sin^{-1}\frac{h(n/2-1)}{2R}$$

where R is a radius of the circle, and h is a difference in height between two adjacent hammer pins.

3. The dot line printer according to claim 2, wherein n is equal to or greater than two.

4. The dot line printer according to claim 1, wherein said hammer bank comprises a joint block having a surface confronting the peripheral surface of said cylindrical platen, the surface of said joint block being substantially in flush with the first surface and the second surface.

5. The dot line printer according to claim 1, wherein said plurality of print hammers are divided into a predetermined number of groups, each group containing n/2-number print hammers.

6. The dot line printer according to claim 5, wherein the print pins of the print hammers in each group are shifted an amount corresponding to one dot.

* * * * *